United States Patent [19]

Sasaki et al.

[11] Patent Number: 4,841,719

[45] Date of Patent: Jun. 27, 1989

[54] APPARATUS FOR TRANSPORTING ROVING BOBBINS

[75] Inventors: Kenji Sasaki, Komaki; Shunji Ito, Nagoya, both of Japan

[73] Assignee: Howa Machinery, Ltd., Japan

[21] Appl. No.: 280,581

[22] Filed: Dec. 6, 1988

[30] Foreign Application Priority Data

Dec. 10, 1987 [JP] Japan ..... 62-312942

[51] Int. Cl.[4] ..... D01H 9/18; D01H 9/00

[52] U.S. Cl. ..... 57/281; 57/267; 57/270; 57/276

[58] Field of Search ..... 57/266–268, 57/270, 274, 276, 281

[56] References Cited

U.S. PATENT DOCUMENTS

| | | | |
|---|---|---|---|
| 3,935,699 | 2/1976 | Iida et al. | 57/270 X |
| 4,369,621 | 1/1983 | Kogiso | 57/267 |
| 4,566,263 | 1/1986 | Miyazaki et al. | 57/276 |
| 4,571,931 | 2/1986 | Kupper | 57/281 |
| 4,583,358 | 4/1986 | Krieger et al. | 57/270 X |
| 4,586,326 | 5/1986 | Igel | 57/281 |
| 4,720,967 | 1/1988 | Guttler | 57/281 |
| 4,769,982 | 9/1988 | Kogiso et al. | 57/281 |

*Primary Examiner*—John Petrakes

*Attorney, Agent, or Firm*—Stevens, Davis, Miller & Mosher

[57] ABSTRACT

An apparatus for transporting roving bobbins (Y) along a transportation rail (5) arranged between a spinning process (3) and a roving process (1), comprising bobbin carriages (11), each having a plurality of bobbin hangers (13) for suspendingly holding roving bobbins (Y) and movably supported by the transportation rail (5); a driving device (18) for intermittently displacing the bobbin carriage (11); and a roving stripper (35) arranged midway of the transportation rail (5) for clearing off a residual roving on the roving bobbin (Y) during the transportation of the carriage (11). A miss bobbin treatment device (40) is provided midway of the transportation rail (5) between the roving stripper (35) and the roving process (1), for automatically removing a miss bobbin from which the residual roving is not completely cleared off by the roving stripper (35) from the bobbin hanger (13) and, instead, donning a normal empty bobbin (Y) onto the bobbin hanger (13), whereby the efficiency of the apparatus is greatly enhanced.

7 Claims, 10 Drawing Sheets

APPARATUS FOR TRANSPORTING ROVING BOBBINS

BACKGROUND OF THE INVENTION

1. Field of the Invention

The present invention relates to an apparatus for delivering roving bobbins from a roving process to a spinning process and returning the same to the roving process through a roving stripper.

2. Description of the Related Art

In a conventional roving bobbin transporting system for delivering full roving bobbins from a roving process comprising a plurality of roving frames to a spinning process comprising a plurality of spinning frames and returning empty bobbins from the spinning process to the roving process, as is well-known, the full bobbin formed in the roving frame is delivered to the spinning process while hung down from a bobbin hanger of a bobbin carriage and exchanged with an empty bobbin with residual roving on a creel of a spinning frame. The empty bobbin is then transferred, while hung down from the bobbin hanger of the bobbin carriage, to a roving stripper arranged on a path of the bobbin carriage, in which the residual roving is cleared off from the roving bobbin. Thereafter, the empty bobbin loaded on the bobbin carriage is transferred to the roving process and exchanged with a full bobbin formed on a bobbin wheel of the roving frame to be doffed. In this system, it often happens that the roving is still left on the empty bobbin even after passing through the roving stripper. If such the bobbin (miss bobbin) is donned on the roving frame, loading miss of a roving on the bobbin at the initial stage of winding is liable to occur. To avoid this mistake, according to the conventional system, a detector is provided for detecting the miss bobbin. If the miss bobbin is found, transfer of the bobbin carriage is made to stop and simultaneously an operator is informed of the presence of the miss bobbin. Then the miss bobbin is manually exchanged with a normal empty bobbin without residual roving. Thereafter, a reset button is depressed to restart the bobbin carriage.

As stated above, according to the conventional system, when the miss bobbin is detected by the detector, the delivery of the roving bobbins is interrupted for a considerable time until the bobbin exchange is completed by the operator, whereby the efficiency of the system is reduced. In addition, if the frequency of the presence of the miss bobbin is high, other bobbin carriages running on a common transportation rail must be stopped, which causes the interruption of the supply of full roving bobbins to the spinning frame with the result of reduction of the throughput of the spinning process. So far as the existent roving stripper is used, miss bobbins often appear, and reduction of the delivery efficiency of roving bobbins is a serious problem to be solved.

SUMMARY OF THE INVENTION

Thus, it is an object of the present invention to solve the above-mentioned drawbacks of the prior arts and provide an improved apparatus for transporting roving bobbins between a spinning process and a roving process, having a high efficiency.

This object is achievable by an apparatus for transporting roving bobbins along a transportation rail arranged between a spinning process and a roving process, comprising bobbin carriages, each having a plurality of bobbin hangers for suspendingly holding roving bobbins and movably supported by the transportation rail; a driving device for intermittently displacing the bobbin carriage; and a roving stripper arranged midway of the transportation rail for clearing off a residual roving on the roving bobbin. According to the present invention, a miss bobbin treatment device is provided midway of the transportation rail between the roving stripper and the roving process, for removing a miss bobbin, from which the residual roving has not been completely cleared off by the roving stripper, from the bobbin hanger and, instead, donning a normal empty bobbin onto the bobbin hanger. The miss bobbin treatment device comprises; a detector, arranged midway of the transportation rail between the roving stripper and the roving process, for detecting presence and absence of the residual roving on the roving bobbin after the roving bobbin has been treated by the roving stripper; a peg for selectively holding the miss bobbin and the normal empty bobbin; a bobbin lift for displacing the peg between a first position at which the roving bobbin is transferred between the bobbin hanger of the bobbin carriage and the peg and a second position at which the normal empty bobbin is donned onto the peg; means for withdrawing the miss bobbin held on the peg therefrom during the downward displacement of the peg; and means for feeding the normal empty bobbin to the peg; wherein the removal of the miss bobbin from the bobbin hanger is carried out by the co-operation of the peg, the bobbin lift, and the miss bobbin withdrawal means, and the donning of the normal empty bobbin is carried out by the co-operation of the peg, the bobbin lift and the normal empty bobbin feeding means.

Preferably, the bobbin lift comprises a base stationarily fixed to a floor on which the apparatus is installed; a pair of vertical pillars fixedly secured on the base; a lifting body mounted on the pillars and movable up- and downwards; an arm fixedly secured on the lifting body while fixedly holding the peg thereon; and a lifting mechanism for displacing the lifting body along the pillars.

Preferably, the miss bobbin withdrawal means is provided midway of the downward path of the lifting body and comprises a bobbin withdrawing mechanism for removing the miss bobbin from the peg during the downward displacement thereof and a box for accommodating the miss bobbin removed from the peg; the bobbin withdrawing mechanism being provided with an operating plate having an opening which allows the passage of the peg but inhibits the passage of the bobbin.

Advantageously, the normal empty bobbin feeding means comprises a frame fixedly secured on a floor on which the apparatus is installed; a supporting box fixedly mounted onto the frame; and a chute, fixedly mounted onto the upper part of the frame, having an inlet opening in the upper portion thereof for introduction of the normal empty bobbin and an exit opening in the lower portion thereof which confronts the top of the peg when the latter occupies the lowermost position; the chute being provided midway thereof with a bobbin stopper mechanism for delivering the normal empty bobbin one by one to the exit opening.

Advantageously, the bobbin lift comprises a base stationarily fixed to a floor on which the apparatus is installed; a pair of vertical pillars fixedly secured on the base; a lifting body mounted on the pillars and movable up- and downwards; a peg holder mounted on the lifting body and movable in the horizontal direction while fixedly holding the peg thereon; means for guiding the peg holder to a position at which the miss bobbin is removed from the peg by the miss bobbin withdrawal means during the downward displacement of the lifting body from the first position, then guiding the peg holder to the second position and finally guiding the peg holder directly from the second position to the first position; and a lifting mechanism for displacing the lifting body along the pillars.

Preferably, the apparatus further comprises a pair of guiding rails arranged in parallel to the transportation rails on the floor on which the apparatus is installed at a position between the roving stripper and the roving process; and a truck reciprocatedly movable along the guiding rails; the miss bobbin treatment device being fixedly mounted on the truck so that when one group of the empty roving bobbins hung from the bobbin hangers of one bobbin carriage is subjected to the clearing-off operation of the roving stripper, the other group of the empty roving bobbins hung from the bobbin hangers of the other bobbin carriage which has been treated by the roving stripper can be simultaneously subjected to the operation of the miss bobbin treatment device.

Advantageously, the chute of the miss bobbin treatment device has a plurality of inlet openings in the upper portion of the chute for introduction of the normal empty bobbins, each corresponding to one normal empty bobbin supply source different from the other, and a selection mechanism for selectively connecting the normal empty bobbin supply source with the inlet opening, and a central control unit for selectively operating the selection mechanism when the bobbin carriage waiting on the stock rail reaches the operative position of the miss bobbin treatment device are provided.

BRIEF DESCRIPTION OF THE DRAWINGS

The other objects and advantages of the present invention will be apparent from the description of the preferred embodiments of the present invention with reference to the accompanying drawings: wherein.

DESCRIPTION OF THE PREFERRED EMBODIMENTS

Figure 1:
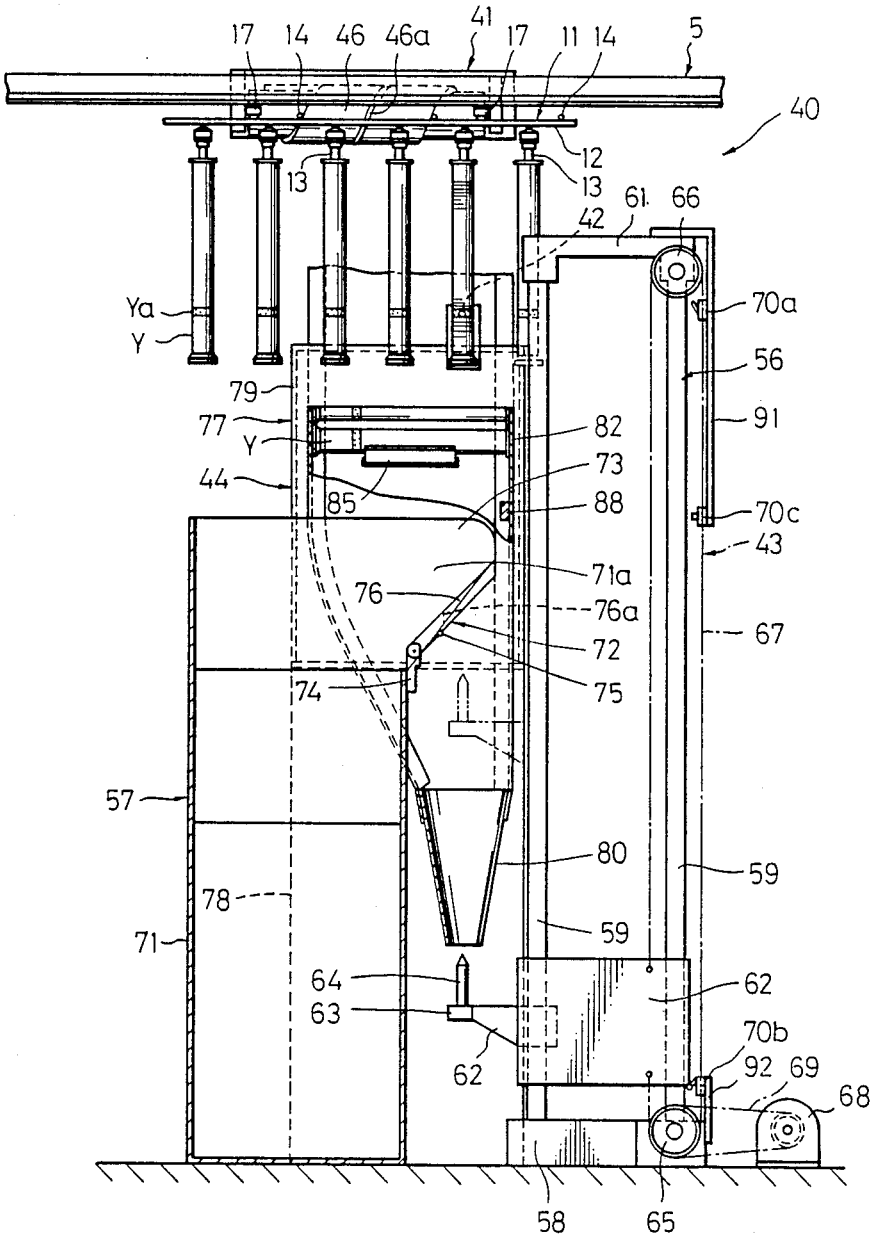
FIG. 1 is a front view of a miss bobbin treatment device used in a first embodiment of the present invention.
Figure 2:
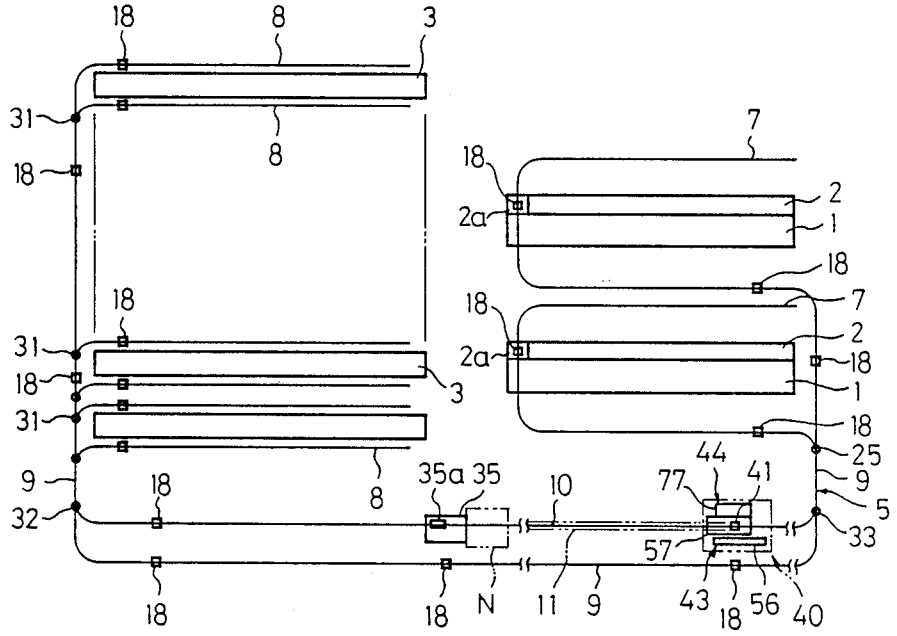
FIG. 2 is a plan view showing a layout of an apparatus for transporting roving bobbins according to the present invention.

FIGS. 1 through 7 illustrate a first embodiment of an apparatus for transporting roving bobbins. Referring to FIG. 2, a roving process is formed by a plurality (two in this drawing) of roving frames 1 arranged in parallel to each other. An auto-doffer, such as disclosed in U.S. Pat. No. 4,369,621 or 3,935,699, is arranged in front of the roving frames 1 to automatically exchange an empty bobbin hung down on a bobbin hanger of a bobbin carriage, described hereinafter, with a full bobbin formed on a bobbin wheel of the roving frame 1. The bobbin exchange may be manually carried out. A spinning process is formed by a plurality of spinning frames 3. As is well-known, the spinning frame 3 has front and rear rows of bobbin hangers on a creel. A roving exchanger, such as disclosed in EPA No. 0213962, is arranged in front of the spinning frame 3 to successively exchange an empty bobbin exhausted on the spinning frame and hung down on the bobbin hanger of the creel with a full bobbins hung down on a bobbin carriage supported on a spare rail described later. In this regard, the empty bobbin transferred to the bobbin carriage at a position of the spare rail may be referred to as "empty (roving) bobbin with residual roving", which means several layers of roving are left on the periphery of the bobbin. While, a bobbin, from which the residual roving has been completely removed, will referred to as "normal (empty) bobbin".

A transportation rail 5 is laid out overhead of a path between the roving process and the spinning process. The transportation rail 5 comprises doffing rails 7 arranged above the surroundings of the roving frames 1, spare rails 8 arranged in front of the creels of the respective spinning frames 3, a main rail 9 arranged to connect the doffing rails 7 to the spare rails 8, and a residual roving treating rail 10 branched in parallel to the main rail 9 from a midportion of the main rail 9. The doffing rail 7 is laid out so as to pass through a point 2*a* just above a position at which the roving bobbins are doffed and donned by the auto-doffer 2. The transportation rail 5 is formed to be of a C-shaped cross-section as shown in FIG. 3, and a pair of bearing surfaces 5*a* and a pair of guide surfaces 5*b* are formed in the bottom thereof.

Figure 3:
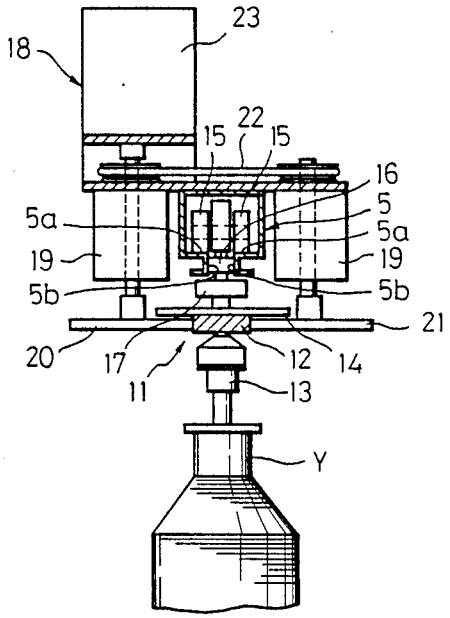
FIG. 3 is a sectional view showing a main part of a bobbin carriage and a driving device therefor.

As is well-known, a plurality of bobbin carriages 11 are movably supported on the transportation rail 5, and as shown in FIGS. 2 and 3, a plurality of carriage bars 12 are rotatably supported on the bobbin carriage 11 through pins. Bobbin hangers 13 are attached to the bottom of the bar 12 at a pitch two times the spindle pitch of the spinning frame 3. Engaging pins 14 are attached to the top of the bar 2 at a pitch two times the pitch of the bobbin hangers 13. A pair of supporting rollers 15, a pair of a guide rollers 16 and a steering roller 17 are arranged in the vicinity of both ends of the carriage bar 12 so that the supporting rollers 15 are guided by the bearing surfaces 5*a* of the transportation rail 5. The guide rollers 16 are guided by the guide surfaces 5*b* of the transportation rail 5.

As shown in FIGS. 2 and 3, a plurality of driving devices 18 for moving the bobbin carriages 11 are arranged on the transportation rail 5 at a pitch shorter than the length of the bobbin carriage 11. As disclosed in U.S. Pat No. 4,769,982, the driving device 18 comprises a pair of discs 20 and 21 which are rotatably supported on a bearing member 19 secured to the transportation rail 5 to interpose both the sides of the carriage bar 12 between the discs 20 and 21, and which are connected to each other so that the discs 20 and 21 are rotated in directions opposite to each other. A driving motor 23 is arranged for driving one of the discs 20, 21. Alternative to this driving device 18, a tractor moving along the transportation rail 5 may be used for drawing the bobbin carriage 11.

Figure 4:
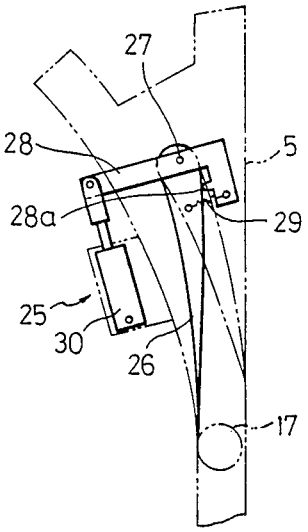
FIG. 4 is a plan view of a switching device.

A switching device 25 shown in FIG. 4 is arranged at a junction between the main rail 9 and the doffing rail 7. In this switching device 25, a switching piece 26 is pivoted on the transportation rail 5 through an axle 27 to guide the steering roller 17 of the bobbin carriage 11. A lever 28 pivoted through the axle 27 is urged by a spring 29 arranged between the lever 28 and the switching piece 26 so that the lever 28 abuts against a stopper 28*a* and is integrated therewith. An air cylinder 30 for turning the lever 28 is fixed to the transportation rail 5 and the switching piece 26 is changed over between the positions indicated by a solid line and an imaginary line in FIG. 4 by the operation of the air cylinder 30. In this regard, switching devices 31, 32 and 33 having the same structure as that of the switching device 25 are arranged at a junction between the main rail 9 and the spare rail 8 and at a junction between the main rail 9 and the residual roving-treating rail 10.

A known roving stripper 35 as disclosed in Japanese Unexamined Patent Publication No. 62-90337 is arranged in a midportion of the residual rail 10. In the roving stripper 35, the bobbin carriage 11 is intermittently forwarded by a known driving device 35*a* arranged within the roving stripper 35 to feed a plurality (for example, 8) of empty bobbins Y to a working zone within the stripper 35. These empty bobbins Y are pressed to a belt having a plurality piles implanted thereon by a pressing wheel. The implanted belt moves in the direction so that the residual roving on the bobbin is rewound and removed from the bobbin. Then, compressed air is blown to the periphery of a band (sticking cloth) Ya of the roving bobbin Y from the tangential direction thereof to remove the residual roving adhering to the band Ya. Thereafter, the bobbin carriage 11 is again subjected to transportation. The roving stripper 35 may be of a type, for example, as disclosed in Japanese Unexamined Patent Publication No. 60-94628, in which a suction opening having a length equal to the that of the winding area of the roving bobbin Y is brought close to the periphery of the roving bobbin Y, and the roving bobbin Y is rotated in the re-winding direction to suck and remove the residual roving.

A miss bobbin treatment device 40 is arranged midway of the transportation path of the bobbin carriage 11 between the roving stripper 35 and the roving frame 1. As shown in FIG. 1 and FIGS. 5 through 7, this miss bobbin-treatment device 40 comprises a driving device 41 for forwarding the bobbin carriage 11, a detector 42 for detecting the presence or absence of a residual roving on the empty bobbin Y which has been subjected to the clear-off treatment of the roving stripper, a bobbin removal device 43 for taking out the miss bobbin from the bobbin hanger 13 on receipt of a signal of "presence of miss bobbin" emitted from the detector 42, and a bobbin attachment device 44 for attaching a roving-free normal empty bobbin to the bobbin hanger 13, from which the empty bobbin with residual roving has been taken out. In the driving device 41 shown in FIGS. 6 and 7, a supporting member 45 is fixed to the upper surface of the transportation rail 5 through a bracket 49*a*. A pair of arms 45*a* of the supporting member 45 rotatably support a shaft 47 of a drum 46 parallel to the transportation rail 5. A screw groove 46*a* is formed on the periphery of the drum 46 so that the screw groove 46 can engage with the end of the engaging pin 14 of the bobbin carriage 11. The screw groove 46*a* is formed so that while the screw groove 46*a* engages with one engaging pin 14, the screw groove 46*a* falls in engagement with another engaging pin 14 and, as the bobbin carriage 11 is forwarded, the screw groove 46*a* naturally falls in engagement with the leading engaging pin 14. An electromagnetic clutch 48 is secured to the supporting member 45 to detachably connect the shaft 47 to an input shaft 50. A motor 51 is fixed to the supporting member 45 through a bracket 49*b* and a belt 54 is wound between a pulley 52 mounted on a driving shaft 51*a* of the motor 51 and a pulley 53 mounted on the input shaft 50.

Figure 5:
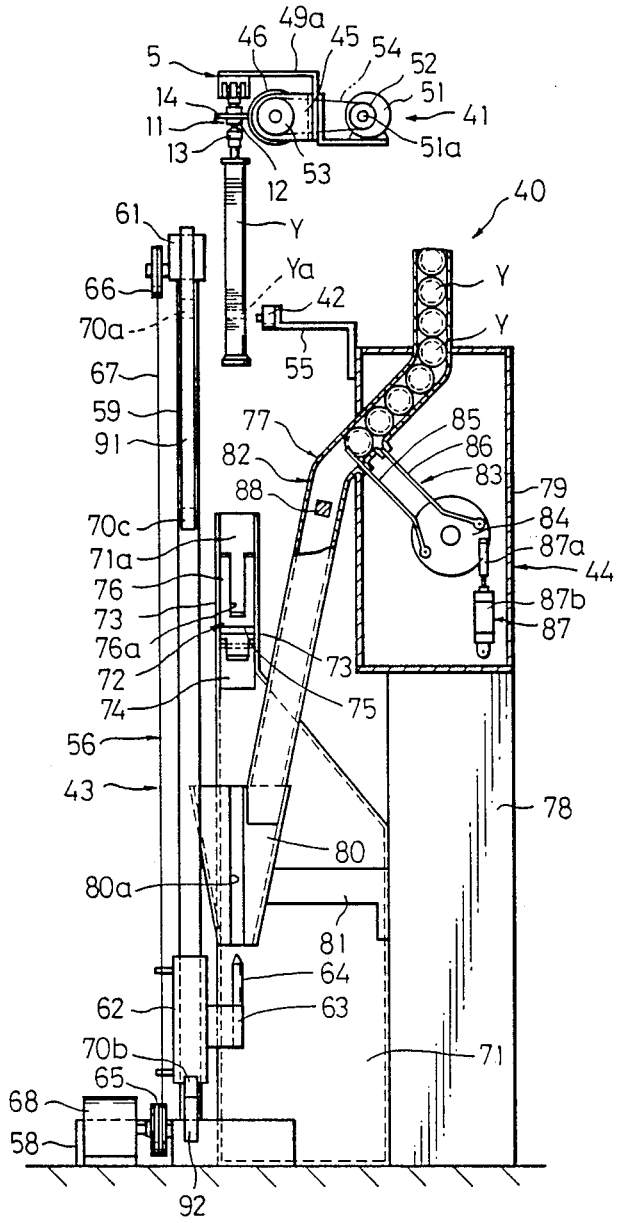
FIG. 5 is a side view illustrating, partially in section, the miss bobbin treatment device shown in FIG. 1.
Figure 6:
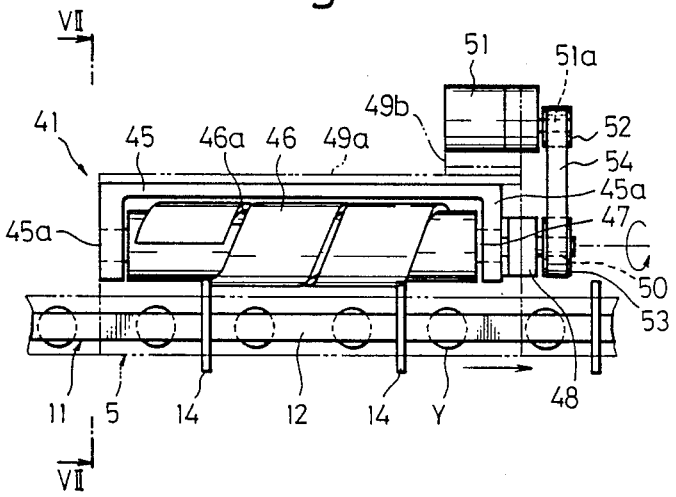
FIG. 6 is a plan view of a driving device for the miss bobbin treatment device.
Figure 7:
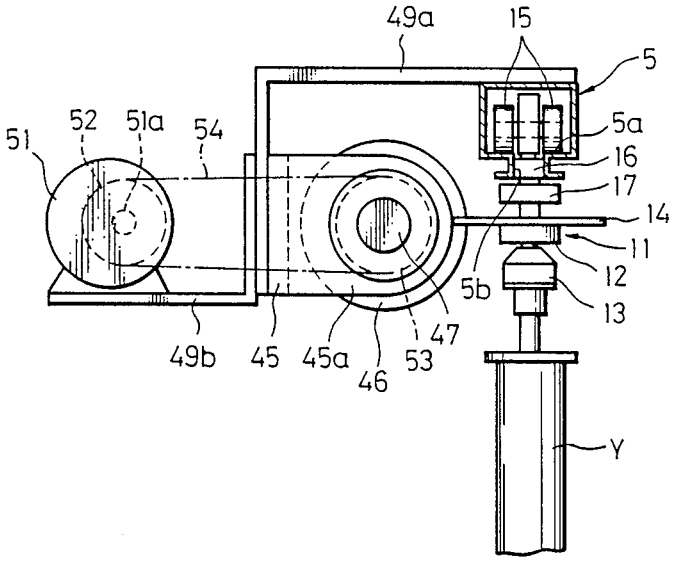
FIG. 7 is an enlarged sectional view taken along the line VII—VII in FIG. 6.

As shown in FIGS. 1 and 5, the detector 42 comprises a light projector and receiver fixed to a supporting frame, described hereinafter, of the bobbin attachment device 44 through a bracket 55, so that the presence or absence of the residual roving on the bobbin Y hung down on the bobbin hanger 13 at the position of the band Ya is detected and a signal is emitted on detection of the residual roving.

The above-mentioned bobbin removal device 43 comprises a bobbin lift 56 for removing the miss bobbin Y from the bobbin hanger 13 and bringing down the same and a bobbin withdrawal device 57 for withdrawing the miss bobbin Y brought down by the bobbin lift 56. In this bobbin lift 56, a base 58 is stationarily fixed on the floor, on which a pair of pillars 59 are vertically arranged. Top end portions of the pillars 59 are fixed to an upper frame 61. A lifting body 62 is vertically movably attached to the pillars 59 and an arm 63 is fixed to the side of the lifting body 62. The width of the arm 63 is smaller than the maximum outer diameter of the empty bobbin Y, and a peg 64 is projected upward from the free end of the arm 63. Chain wheels 65 and 66 are turnably mounted on the base 58 and upper frame 61, respectively, and a chain 67 having both the ends fixed to the lifting body 62 is wound around each chain wheel. A motor 68 is arranged to drive the chain wheel 65 in either the normal direction or the reverse direction through a chain 69. Limit switches 70*a*, 70*b* and 70*c* are fixed to the upper frame 61 and base 58 through brackets 91 and 92 to detect the rise end, drop end and stand-by position of the lifting body 62.

The limit switch 70*c* is set at a stand-by position where the peg 64 can get out from a lower hole of the roving bobbin Y in the hung-down state, and ordinarily, the lifting body 62 rests at the stand-by position. In the bobbin withdrawal device 57, a bobbin container 71 is disposed on the floor on the side of the up-down path of the peg 64. A narrow opening is formed on the upper end of the bobbin container 71 so that one empty bobbin Y can be received in a laid-down state. A bobbin withdrawing mechanism 72 is attached to the top of the bobbin container 71, which comprises opening 71*a* formed on the side of the upper portion of the bobbin container 71, a pair of guide plate which is formed by projecting side walls of the opening 71*a* so that the miss bobbin Y held on the peg 64 is guided thereby during the downward displacement. A baffle plate 76, which is rotatably pivoted on a bracket 74 fixed to the lower wall of the bobbin container 71 beneath the opening 71*a*, is normally urged to the right, as shown in FIG. 1, by a spring (not shown) or by its own weight so that it obliquely crosses the downward path of the bobbin Y mounted on the peg 64. A stopper 75 limits the motion of the baffle plate 76. A window 76*a* which has such a size as allowing passage of the arm 63 and peg 64 but not allowing passage of the miss bobbin Y inserted in the peg 64 is formed on the baffle plate 76.

The bobbin attachment device 44 is constructed by the above-mentioned bobbin lift 56 and a bobbin supply device 77. In the bobbin supply device 77, a supporting frame 78 is arranged on the floor. A supporting box 79 is secured on the supporting frame 78. A lower chute 80 is arranged slightly above the peg 64, when the same occupies the above-mentioned lowermost position, through a bracket 81 fixed to the supporting frame 78, and a notch 80*a* allowing passage of the arm 63 is formed on the side of the lower chute 80. An upper chute 82 is arranged to supply a roving-free normal empty bobbin Y preliminarily prepared to the lower chute 80, and the upper portion of the upper chute 82 is formed to have such a broad width that the normal bobbin Y is guided while laid down horizontally, and this width-increased portion is passed through the supporting box 79 so that said portion is supported by the supporting box 79. The width of the lower portion of the upper chute 82 is gradually narrowed and is connected to the lower chute 80. The upper end of the upper chute 82 is connected to a supply box or supply conveyor (not shown) for feeding a normal empty bobbin Y. A bobbin-stopping device 83 for supplying bobbins Y one by one comprises a rotary disc 84 rotatably pivoted on the inner wall of the supporting box 79, stopping members 85 and 86 having one ends connected to positions symmetrically with each other with respect to the center of rotation of the rotary disc 84 and the other ends floatably inserted in the upper chute 82, and an air cylinder 87 for rotating the rotary disc 84 by a predetermined angle to cause the stopping member 85, 86 to emerge alternately in the upper chute 82, with a piston rod 87*a* and a body 87*b* of the air cylinder being pivoted, respectively, to the rotary disc 84 and to the supporting box 79. A braking member 88 is stationarily arranged on one side of the passage in the upper chute 82 to regulate the falling posture of the bobbin Y, as described later.

In this apparatus having the above-mentioned structure, a full roving bobbin Y is attached to the bobbin hanger 13 of the bobbin carriage 11 supported on the doffing rail 7 at the position of the roving frame 1, and then, these bobbin carriages 11 are delivered to the main rail 9 in succession by the driving device 18 and are supported on the spare rail 8 at the position of the spinning frame 3. At this position, the full roving bobbin Y is exchanged with the empty bobbin Y with residual roving on the creel. Then, the bobbin carriages 11 at the position of the spare rail 8 are returned onto the main rail 9 in succession and transported to the residual roving-treating rail 10. At this position, the empty bobbin Y hung down on the bobbin hanger 13 is fed to the roving stripper 35. Plural numbers of these empty bobbins Y are fed intermittently at predetermined pitches to the roving stripper 35 by the driving device 35*a*, and the clear-off treatment is carried out to remove the residual roving.

When the clear-off treatment is completed and the bobbin carriage 11 is completely fed out from the roving stripper 35, the leading engaging pin 14 abuts against the drum 46 of the driving device 41 of the miss bobbin-treatment device 40 to rotate the drum 46. Then, the pin 14 falls in engagement with the screw groove 46*a*. When the bobbin carriage 11 reaches the drum 46 as mentioned above, this displacement is detected by a detector not shown to actuate the motor 51, and the drum 46 is rotated in the direction indicated by an arrow in FIG. 6 by the rotation of the shaft 51*a* of the motor 51, with the result that the bobbin carriage 11 is slowly but continuously displaced to the right in FIG. 1. Accordingly, empty bobbins Y which have been subjected to the clear-off treatment are delivered in succession to the position confronting the detector 42 which detects the presence or absence of the residual roving on the periphery of the band portion Ya of the bobbin Y. When the detector 42 detects the presence of the residual roving, a signal indicating that this roving bobbin Y is a miss bobbin is issued, and the motor 51 is immediately stopped by this signal to stop the miss bobbin just above the peg 64 of the bobbin removal device 43. In this regard, in order to increase the stopping accuracy, the motor 51 can be stopped by using this signal in combination with a signal of another detector for detecting the engaging pin 14 or the like. The bobbin carriage 11 stands still until a predetermined short period set by a non-illustrated timer lapses after the detector 42 has issued the signal indicating the presence of miss bobbin, so that a rocking of the roving bobbins on the bobbin carriage 11 is minimized. Then, the motor 68 of the bobbin lift 56 is actuated to raise the lifting body 62 located at the stand-by position. When the lifting body 62 is raised to actuate the limit switch 70*a*, the operation of the motor 68 is stopped and the lifting body 62 is also stopped at the rising end. At this position, the miss bobbin is slightly lifted up, from the normal hanging-down position, by the peg 64 which is now engaged with the lower hole of the miss bobbin, whereby the removal of the miss bobbin from the bobbin hanger is carried out. After the limit switch 70*a* is actuated, a predetermined short period set by a non-illustrated timer lapses. Then, the motor 68 is actuated reversely to lower the lifting body 62 to bring down the miss bobbin Y removed from the bobbin hanger 13. In the passage of the downward movement of the lifting body 62, the miss bobbin Y impinges against the baffle plate 76 of the bobbin withdrawal device 57 and is drawn out from the peg 64 and put into the bobbin container 71. The miss bobbin Y is brought down through the window 76*a* of the baffle plate 76. When the lifting body 62 actuates the limit switch 70*b*, the operation of the motor 68 is stopped and the lifting body 62 is stopped on the falling end.

Then, the air cylinder 87 of the bobbin supply device 77 in the bobbin attachment device 44 is actuated by a signal issued from the limit switch 70*b* to project the piston rod 87*a*, so that the rotary disc 84 is rotated counterclockwise in FIG. 5, and the lower stopping member 85 is escaped from the upper chute 82 while the upper stopping member 86 is projected in the upper chute 82. Thereby one normal empty bobbin Y alone is let to fall in the upper chute 82. In the course of this falling, the head of the falling empty bobbin Y impinges against the braking member 88 and temporarily braked, and therefore, the lower part of the roving bobbin Y is first dropped. The next normal empty bobbin Y is received on the stopping member 85 by the projection of the stopping member 85 and the retreat of the stopping member 86 and occupies a stand-by position for the next exchange. Then, the normal empty bobbin Y is supplied to the lower chute 80 and is attached to the peg 64 standing by at the falling end. When this attachment is detected by a detector, such as a photo-tube, not shown in the drawings, the motor 68 of the bobbin lift 56 is actuated again to raise the lifting body 62 together with the normal empty bobbin Y attached to the peg 64. In this case, the arm 63 is passed through the notch 80*a* of the lower chute 80 without interference. In the course of the upward movement of the normal empty bobbin Y, the head thereof impinges against the baffle plate 76, but since the baffle plate 76 is rotatable upward, the bobbin Y turns the baffle plate 76 upward and continues rising. When the lifting body 62 rises to actuate the limit switch 70*a*, the operation of the motor 68 is stopped and the lifting body 62 is stopped at the rising end. At this point, the upper hole of the bobbin Y is engaged with the bobbin hanger 13. After a predetermined short period set by a timer, the motor 68 is actuated again to bring down the lifting body 62, and the bobbin Y fitted to the bobbin hanger 13 is hung down on the bobbin hanger 13. The arm 63 and the peg 64 free from the bobbin are brought down. When the lifting body 62 actuates the limit switch 70*c*, the operation of the motor 68 is stopped and the lifting body 62 is stopped at the stand-by position. Then, the motor 51 of the driving device 41 is actuated again by a signal from the limit switch 70*c*. The above operation is repeated to displace the bobbin carriage 11 to the right in FIG. 1, and miss bobbins Y are automatically exchanged with normal empty bobbins Y in a short time. When the treatment of miss bobbins of one bobbin carriage 11 is thus completed, this completion is detected by an appropriate detector, and the bobbin carriage 11 is delivered to the predetermined doffing rail 7 by the driving device 18, and at this position, normal empty bobbins Y hung down on the bobbin hanger 13 of the bobbin carriage 11 are exchanged with full bobbins.

Figure 8:
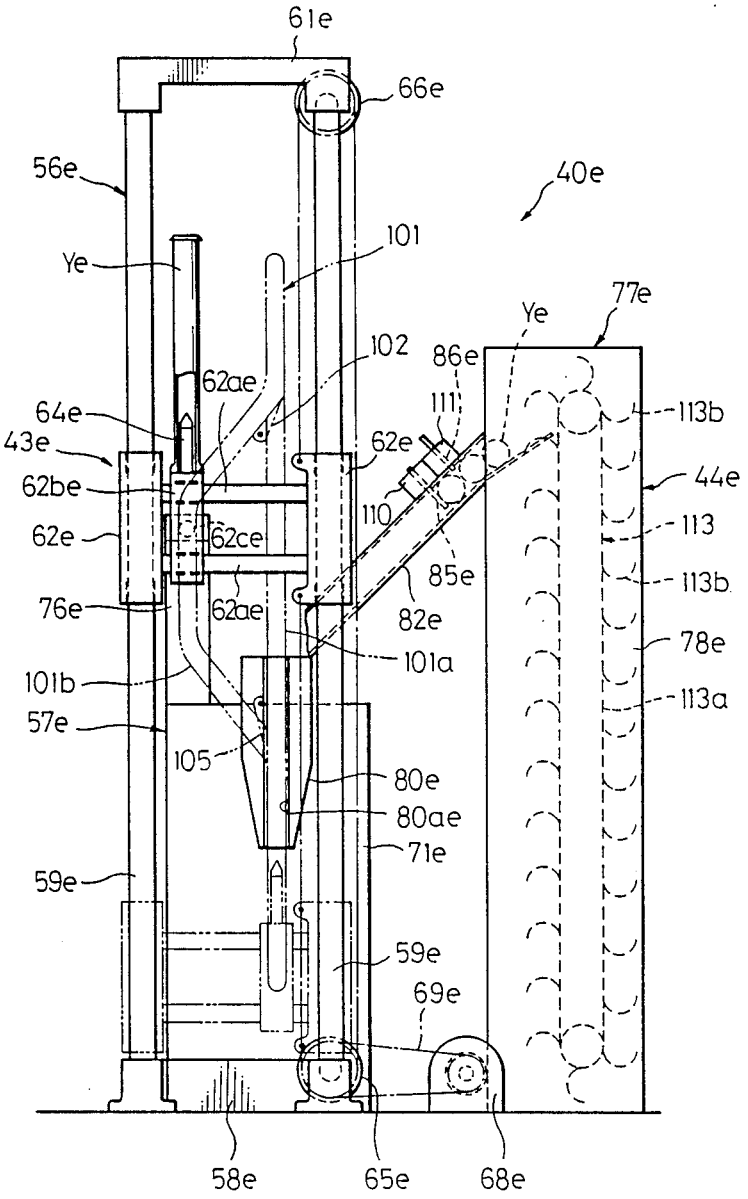
FIG. 8 is a front view of a miss bobbin treatment device used in a second embodiment of the present invention.
Figure 9:
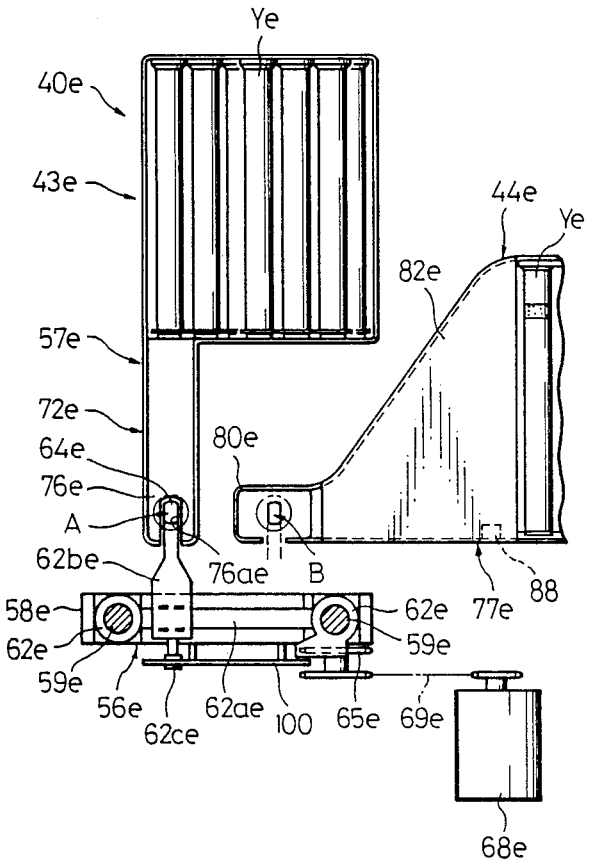
FIG. 9 is a plan view illustrating, partially in section, the device of FIG. 8.
Figure 10:
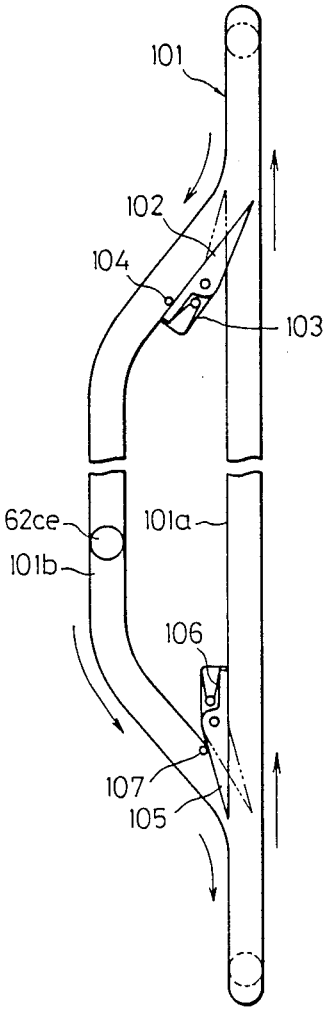
FIG. 10 is a diagram illustrating a cam groove used in the second embodiment.

FIGS. 8 through 10 illustrate the second embodiment of the miss bobbin-treatment device of the present invention. The horizontal phase of the bobbin removal position A of a bobbin withdrawal device 57*e* is made different from that of the bobbin inserting position B of a bobbin supply device 77*e*, so that a peg 64*e* of a bobbin lift 56*e* is moved between the bobbin removal position A and the bobbin inserting position B in the course of the vertical movement. In the bobbin lift 56*e*, two horizontal guide bars 62*ae* are arranged in parallel to each other on a lifting body 62*e*. Laterally moving members 62*be* are attached to the guide bars 62*ae* so that they can move laterally, and cam followers 62*ce* formed on the laterally moving members 62*be* are fitted in a cam groove 101 of a cam plate 100. The cam plate 100 is fixed to a base 58*e* and an upper frame 61*e*. As shown in FIG. 10, the cam groove 101 comprises a vertically straight cam groove 101*a* and a second cam groove 101*b* branched from the first cam groove 101*a*. At an upper junction between the first cam groove 101*a* and the second cam groove 101*b*, a switching piece 102 is rotatably pivoted, and the switching piece 102 is urged by a spring 103 and caused to abut against a stopper 104, so that the top end of the switching piece 102 is located at the first cam groove 101*a*. At a lower junction, a switching piece 105 is rotatably pivoted, and the switching piece 105 is urged by a spring 106 and is caused to abut against a stopper 107, so that the top end of the switching piece 105 is located at the second cam groove 101*b*. In the bobbin withdrawal device 57*e*, a baffle plate 76*e* of a bobbin withdrawal mechanism 72*e* is stationarily arranged. In a bobbin attachment device 44*e*, stopping members 85*e* and 86*e* are arranged so that they are projected and retreated by solenoids 110 and 111 arranged in an intermediate portion of a supply chute 82*e*, and a backet conveyor 113 is arranged on a supporting frame 78*e*. The backet conveyor 113 comprises an endless belt 113*a* having many backets 113*b*, fixed to the periphery thereof. The backet conveyor 113 is disposed so that normal empty bobbins Y are supplied to a high position close to the inlet of the upper chute 82*e*.

In the second embodiment, when the lifting body 62*e* falls, the cam follower 62*ce* is guided to the second cam groove 101*b* by the switching piece 102, and as the result, the peg 64*e* passes through the bobbin removal position A of the bobbin withdrawal device 57*e* and a miss bobbin is removed from the peg 64*e*. Then, the cam follower 62*ce* is guided to the bobbin inserting position B or the bobbin supply device 77, and at this position, a normal empty bobbin Ye is attached to the peg 64*e*. When the lifting body 62*e* then rises, the cam follower 62*ce* is guided into the first cam groove 101*a* by the switching piece 105, and the roving bobbin Ye is attached to the bobbin hanger of the bobbin carriage. In this regard, members equal or equivalent to the members described in the above-mentioned first embodiment are indicated by affixing alphabet letter e to the same reference numerals as used in the first embodiment, and detailed explanation of these members is omitted.

Figure 11:
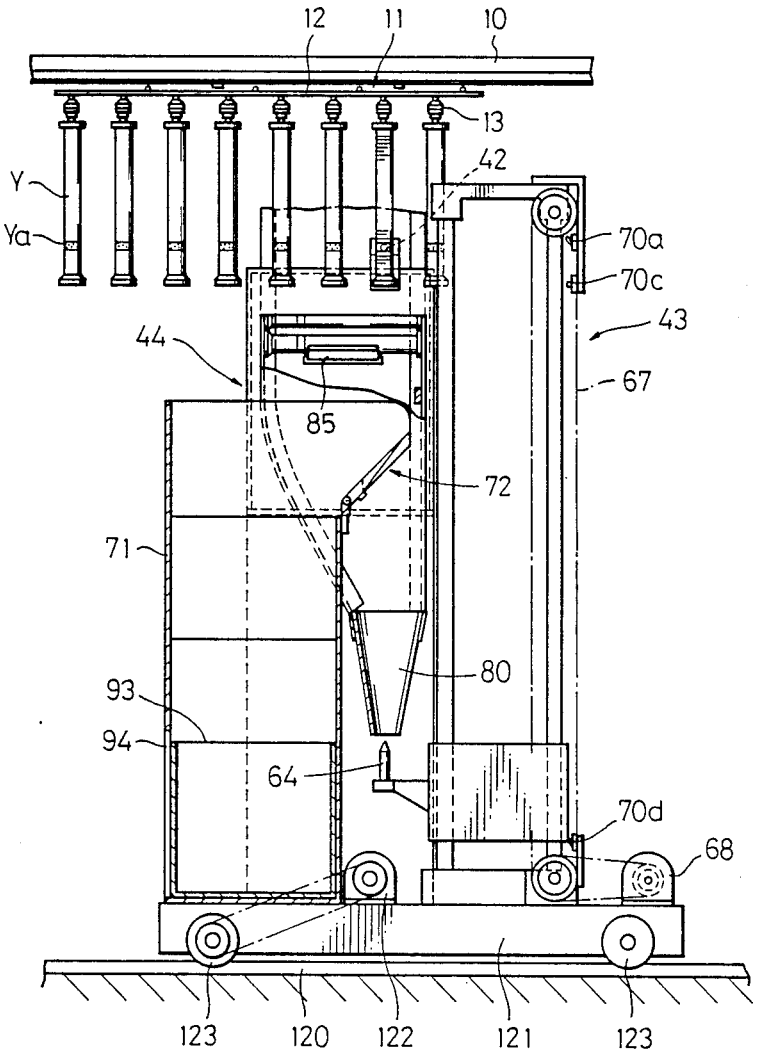
FIG. 11 is a front view of a miss bobbin treatment device used in a third embodiment of the present invention.

In the third embodiment of the present invention illustrated in FIG. 11, while a plurality (for example, 8) of empty bobbins are subjected to the stripping treatment by the above-mentioned roving stripper 35, a plurality of miss bobbins among a plurality of the empty bobbins Y which have been previously subjected to the stripping treatment and fed out are detected and exchanged with normal bobbins. In this embodiment, along the residual roving-treatment rail 10 on the side where the bobbin carriage 11 is fed out from the roving stripper 35, that is, on the right side of the roving stripper 35 in FIG. 2, two guide rails 120 are laid out, and the bobbin removal device 43 and bobbin attachment device 44 of the above-mentioned first embodiment are arranged on a self-advancing truck 121 provided with a wheel 123 rotatable in the normal and reverse directions by a motor 122. In the bobbin container 71 of the present embodiment, a bobbin box 93 for collecting withdrawn miss bobbins therein is arranged so that the bobbin box 93 is taken out and inserted through an opening 94 formed on one side wall of the bobbin box 93. The truck 121 moves reciprocatively just below a plurality of empty bobbins Y fed from the roving stripper, and when a miss bobbin is detected by the detector 42, the motor 122 is stopped and the miss bobbin is exchanged with a normal empty bobbin.

Figure 12:
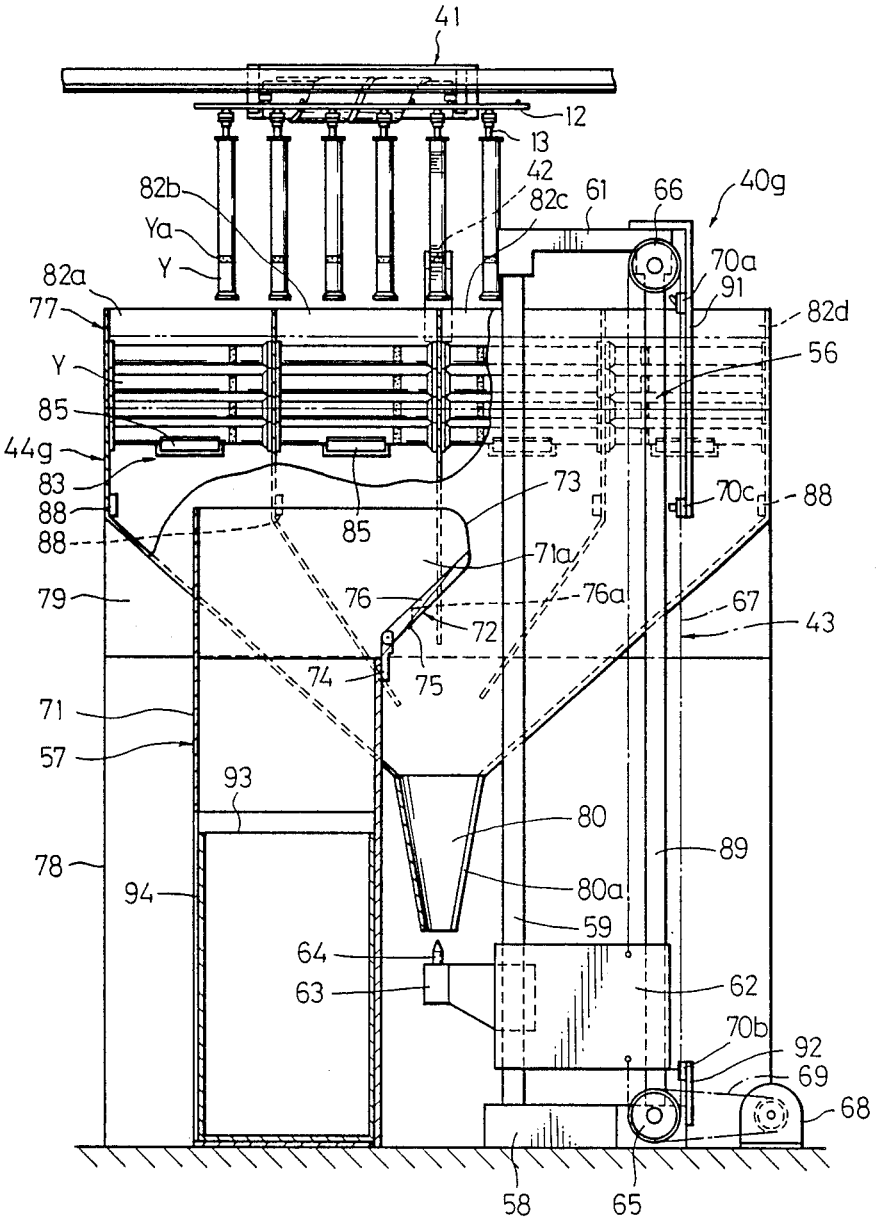
FIG. 12 is a front view of a miss bobbin treatment device used in a fourth embodiment of the present invention.
Figure 13:
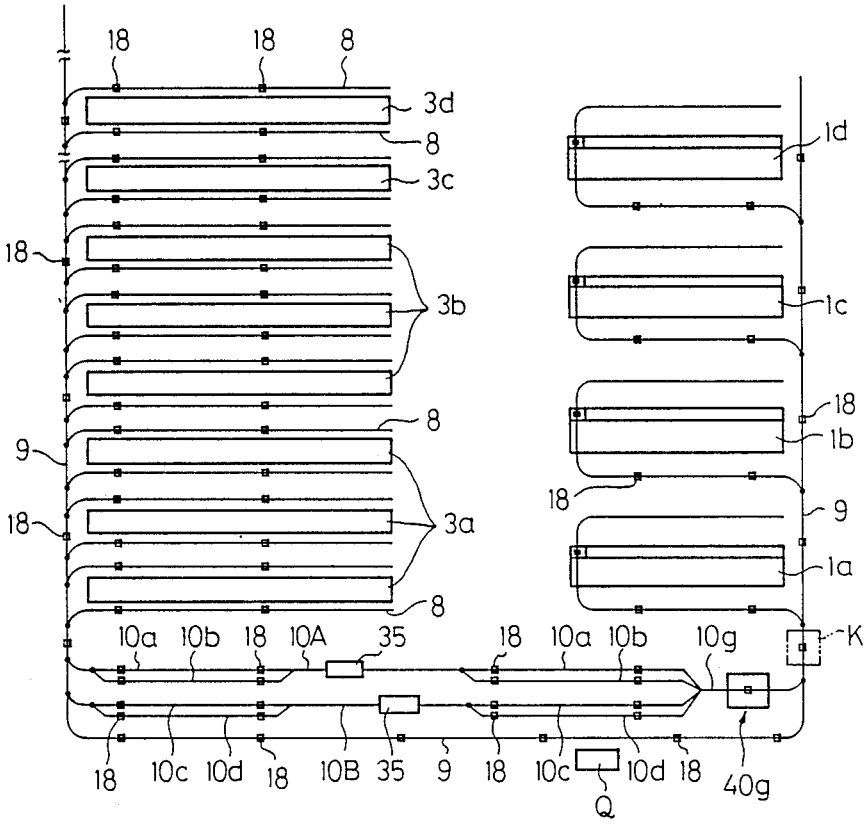
FIG. 13 is a plan view showing a layout of an apparatus for transporting roving bobbins according to the fourth embodiment of the present invention.

In the fourth embodiment of the present invention illustrated in FIGS. 12 and 13, different kinds of rovings (differing, for example, in the count number or the material) are produced from the respective roving frames and many kinds of roving bobbins (in general, roving bobbins having colors corresponding to the kinds of the yarns) are used, and after a miss bobbin is removed from the bobbin hanger of the bobbin carriage, the miss bobbin is exchanged with a normal empty bobbin of the same kind as that of the miss bobbin. Referring to FIG. 13, roving frames 1*a* through 1*d* produce different kinds of rovings, and different colors, for example, red, green, blue and orange, corresponding to the kinds of the yarns, are given to roving bobbins, and rovings of roving bobbins of different colors are fed to four groups of spinning frames 3*a* through 3*d*, each group comprising three spinning frames. Each of the spinning frames is a long spinning frame in which two bobbin carriages are located on the spare rail 8. In the case where four kinds of roving bobbins are thus treated, from the viewpoint of the control of automatic delivery of the bobbin carriages 11, it is preferred that stand-by rails 10*a* through 10*d* corresponding to the respective kinds of roving bobbins be arranged before and after the roving stripper 35. In the present embodiment, the roving stripper 35 is arranged on each of a residual roving treating rail 10A for delivering red and green roving bobbins and a residual roving treating rail 10B for delivering blue and orange roving bobbins. However, alternative to a plurality of rails 10A, 10B, only one residual roving treating rail can be laid out for delivering all kinds of the roving bobbins in one roving stripper 35. A miss bobbin-treatment device 40*g*, illustrated in FIG. 12, is arranged on a residual rolling treating rail 10*g* where the respective stand-by rails 10*a* through 10*d* join. The miss bobbin-treatment device 40*g* may be disposed in an intermediate portion of the main rail 13, as indicated by symbol K in FIG. 13. A bobbin attachment device 44*g* of the miss bobbin-treatment apparatus 40*g* comprises four supply chutes 82*a* through 82*d* having lower portions connected to the lower chute 80, and normal empty bobbins of red, green, blue and orange are supplied to the upper chutes 82*a* through 82*d*, respectively. In this connection, the same members as those of the first embodiment are represented by the same reference numerals as used in the first embodiment, and detailed explanation of these members is omitted.

The stripping treatment of the empty bobbin Y is carried out by the roving stripper 35 in the above-mentioned apparatus, and the bobbin carriage 11, for example, on for red roving bobbins, on the stand-by rail 10*a*, is fed toward the miss bobbin-treatment device 40*d* by instructions from a central control unit Q. In the miss bobbin-treatment device 40*g*, when the peg 64 is lowered after removal of the miss bobbin from the bobbin hanger 13, the bobbin stopping device 83 of the upper chute 82*a*, selected by the central control unit Q, is actuated to drop and supply a red normal empty bobbin, and this bobbin is attached to the bobbin hanger 13, from which the miss bobbin has been removed. Thus, the miss bobbin can be exchanged with a normal empty bobbin Y of the same kind as that of the miss bobbin.

In the present invention, there can be adopted modifications of the foregoing embodiments. For example, there can be mentioned a modification in which the driving device of the roving stripper is constructed so that the bobbin carriage is delivered intermittently at a pitch corresponding to one pitch of the bobbin hanger, and the bobbin removal device and attachment device of the miss bobbin-treatment device are stationarily arranged adjacently to the roving stripper, as indicated by symbol N in FIG. 2. Another modification in which the above-mentioned bobbin removal device and attachment device are arranged integrally with the roving stripper and when a plurality of empty bobbins are subjected to the stripping treatment by the roving stripper and the bobbin carriage is fed out, on detection of a miss bobbin by the detector, feed-out of the bobbin carriage is temporarily stopped and the miss bobbin is exchanged with a normal empty bobbin.

As is apparent from the foregoing description, according to the present invention, when the presence of a residual roving on an empty bobbin which has subjected to the stripping treatment is detected by the detector, on receipt of a detection signal from the detector, the bobbin removal device automatically and rapidly takes out this miss bobbin from the bobbin hanger and the attachment device attaches a normal empty bobbin to the bobbin hanger, from which the miss bobbin has been taken out. Accordingly, the stopping time of the bobbin carriage having this miss bobbin hung down thereon can be much shortened and the efficiency of transportation of roving bobbins can be increased. Even if the appearance frequency of miss bobbins is high, high outputs can be maintained in spinning frames. Moreover, since a miss bobbin can be automatically exchanged with a normal empty bobbin, an operator need not perform any manual operation at all even when miss bobbins appear, and the cost in a spinning mill can be reduced.

We claim:

1. An apparatus for transporting roving bobbins along a transportation rail arranged between a spinning process and a roving process, comprising:

bobbin carriages, each having a plurality of bobbin hanger for suspendingly holding roving bobbins and movably supported by the transportation rail;

a driving device for intermittently displacing the bobbin carriage; and a roving stripper arranged midway of the transportation rail for clearing off a residual roving on the roving bobbin;

characterized in that a miss bobbin treatment device is provided midway of the transportation rail between the roving stripper and the roving process, for removing a miss bobbin from which the residual roving has not been completely cleared off by the roving stripper from the bobbin hanger and, instead, donning a normal empty bobbin onto the bobbin hanger;

the miss bobbin treatment device comprising:

a detector, arranged midway of the transportation rail between the roving stripper and the roving process, for detecting presence and absence of the residual roving on the roving bobbin after the roving bobbin has been treated by the roving stripper;

a peg for selectively holding the miss bobbin and the normal empty bobbin;

a bobbin lift for displacing the peg between a first position at which the roving bobbin is transferred between the bobbin hanger of the bobbin carriage and the peg and a second position at which the normal empty bobbin is donned onto the peg;

means for withdrawing the miss bobbin held on the peg therefrom during the downward displacement of the peg; and means for feeding the normal empty bobbin to the peg;

wherein the removal of the miss bobbin from the bobbin hanger is carried out by the co-operation of the peg, the bobbin lift, and the miss bobbin withdrawal means; the donning of the normal empty bobbin is carried out by the co-operation of the peg, the bobbin lift and the normal empty bobbin feeding means.

2. An apparatus as defined by claim 1, wherein the bobbin lift comprises a base stationarily fixed to a floor on which the apparatus is installed; a pair of vertical pillars fixedly secured on the base; a lifting body mounted on the pillars and movable up- and downwards; an arm fixedly secured on the lifting body while fixedly holding the peg thereon; and a lifting mechanism for displacing the lifting body along the pillars.

3. An apparatus as defined by claim 2, wherein the miss bobbin withdrawal means is provided midway of the downward path of the lifting body and comprises a bobbin withdrawing mechanism for removing the miss bobbin from the peg during the downward displacement thereof and a box for accommadating the miss bobbin removed from the peg; the bobbin withdrawing mechanism being provided with an operating plate having an opening which allows the passage of the peg but inhibits the passage of the bobbin.

4. An apparatus as defined by claim 1, wherein the normal empty bobbin feeding means comprises a frame fixedly secured on a floor on which the apparatus is installed; a supporting box fixedly mounted onto the frame; and a chute, fixedly mounted onto the upper part of the frame, having an inlet opening in the upper portion thereof for introduction of the normal empty bobbin and an exit opening in the lower portion thereof which confronts the top of the peg when the latter occupies the lowermost position; the chute being provided midway thereof with a bobbin stopper mechanism for delivering the normal empty bobbin one by one to the exit opening.

5. An apparatus as defined by claim 4, wherein the chute of the miss bobbin treatment device has a plurality of inlet openings in the upper portion of the chute for introduction of the normal empty bobbins, each corresponding to one normal empty bobbin supply source different from the other, and a selection mechanism for selectively connecting the normal empty bobbin supply source with the inlet opening, and a central control unit for selectively operating the selection mechanism when the bobbin carriage waiting on the stock rail reaches the operative position of the miss bobbin treatment device are provided.

6. An apparatus as defined by claim 1, wherein the bobbin lift comprises a base stationarily fixed to a floor on which the apparatus is installed; a pair of vertical pillars fixedly secured on the base; a lifting body mounted on the pillars and movable up- and downwards; a peg holder mounted on the lifing body and movable in the horiziontal direction whiled fixedly holding the peg thereon; means for guiding the peg holder to a position at which the miss bobbin is removed from the peg by the miss bobbin withdrawal means during the downward displacement of the lifting body from the first position, then guiding the peg holder to the second position and finally guiding the peg holder directly from the second position to the first position; and a lifting mechanism for displacing the lifting body along the pillars.

7. An apparatus as defined by claim 1, wherein said apparatus further comprises a pair of guiding rails arranged in parallel to the transportation rails on the floor on which the apparatus is installed at a position between the roving stripper and the roving process: and a truck reciprocatedly movable along the guiding rails; the miss bobbin treatment device being fixedly mounted on the truck so that when one group of the empty roving bobbins hung from the bobbin hangers of one bobbin carriage is subjected to the clearing-off operation of the roving stripper, the other group of the empty roving bobbins hung from the bobbin hangers of the other bobbin carriage which has been treated by the roving stripper can be simultaneously subjected to the operation of the miss bobbin treatment device.

* * * * *